United States Patent [19]

Anderson

[11] 4,008,535

[45] Feb. 22, 1977

[54] WRITING INSTRUMENT TOP

[75] Inventor: Olof Verner Anderson, North Kingstown, R.I.

[73] Assignee: Anson Incorporated, Providence and Providence Plantations, R.I.

[22] Filed: June 17, 1974

[21] Appl. No.: 480,005

[52] U.S. Cl. ..... 40/334; 401/292

[51] Int. Cl.[2] ..... G09F 3/00

[58] Field of Search .... 401/98, 194, 202, 243–247, 401/262, 292; 40/334

[56] References Cited

UNITED STATES PATENTS

| | | | |
|---|---|---|---|
| 1,514,002 | 11/1924 | Kraker | 401/194 X |
| 2,272,139 | 2/1942 | Tapner | 40/334 |

FOREIGN PATENTS OR APPLICATIONS

| | | | |
|---|---|---|---|
| 781,594 | 2/1935 | France | 40/334 |
| 13,900 | 6/1907 | United Kingdom | 401/194 |

*Primary Examiner*—Lawrence Charles
*Attorney, Agent, or Firm*—William Frederick Werner

[57] ABSTRACT

The present disclosure relates to writing instrument tops as an article of manufacture and specifically to an improved construction and the method of making the same.

4 Claims, 6 Drawing Figures

WRITING INSTRUMENT TOP

STATEMENT OF INVENTION

The present invention relates to a novel construction and a new esthetic appearance in writing instrument tops and the method of making the same.

BACKGROUND OF THE INVENTION

Mechanical writing instruments of the propel-repel type comprise two inter-related tubes. One tube provided with the writing end is termed the body. The other tube removably secured to the body is termed, simply the top. The propel-repel mechanism may be located in the body or in the top. In either event, the lower end of the body tube is provided with the writing element which provides a closure member for the lower end of the body tube. The upper end of the body tube is normally left open and is constructed, so as to removably secure the top to the body.

The lower end of the top tube is open and adapted to cooperate with the open upper end of the body tube so as to be removably secured thereto.

There has always remained a problem of what to do with the open upper end of the top tube. In some instances the top end is swedged over to close the top.

The mechanical writing instrument is classed as an article of jewelry, especially when fabricated from precious metal such as sterling silver and gold-filled or gold-rolled tubes.

The top must therefore present an esthetic appearance to provide sales appeal and a price beyond that of a lead pencil.

Various types of plugs and configurations have been provided to close the top end of the top. Such plugs and configurations have then been used as symbols to indicate the source of manufacture and thereby have become trade marks.

As trade marks, the configurations have remained constant so as to represent the source of manufacture. In this manner, no consideration was given to the personality of the individual who ultimately purchased the article of jewelry for their personal use.

OBJECTS OF THE INVENTION

It is therfore, an object of the present invention to provide a writing instrument top construction, whereby, the personality of the purchaser may be examplified in the writing instrument top.

Another object of the present invention is to provide a new writing instrument top construction and the method of providing the same.

Other objects of the present invention will become apparent in part and be pointed out in part in the following specifications and claims.

Like reference numerals refer to like parts in the following drawings in which.

Figure 1:
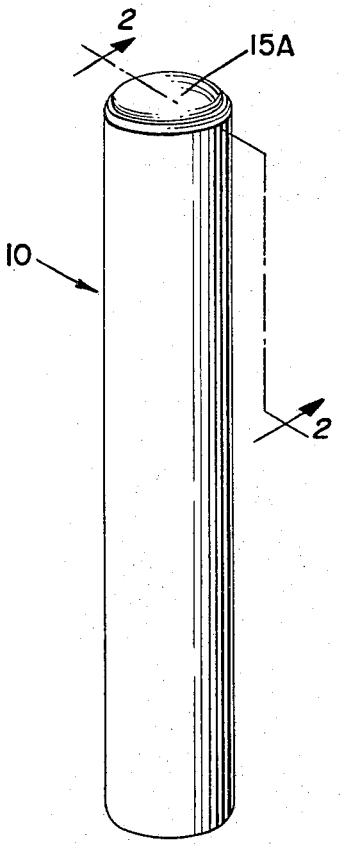
FIG. 1 is a perspective view of the new and improved writing instrument top.

Referring to the drawings, reference numeral 10 generally indicates the new and improved top of a mechanical writing instrument.

Top 10 comprises a hollow tube having a wall 11 and an axial passageway 12.

In order to understand the fragile nature of top 10 due to its fabrication from precious metal and also due to the fact that a writing instrument must be very light in weight; dimensions are given by way of example and not by way of limitation.

Figure 6:
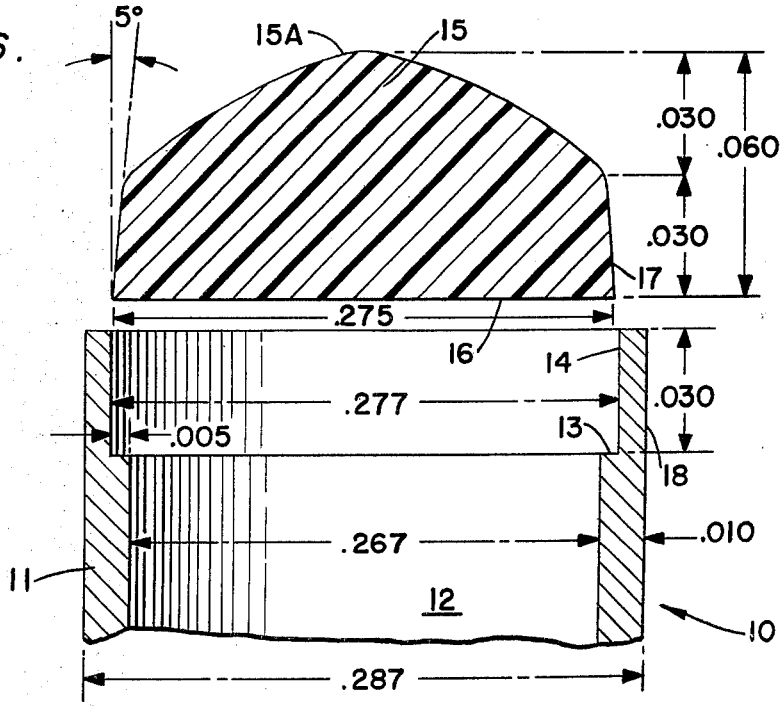
FIG. 6 is an enlarged view of FIG. 3.

Reference is made to FIG. 6 wherein tube 10 has an outside diameter of approximately 0.287 of an inch. The wall of tube 10 is approximately 0.010 of an inch thick. A counterbore 14 is made in the open upper end of the tube to a depth 18 of approximately 0.030 of an inch. The bore 14 having a diameter of approximately 0.277 of an inch, leaving a shelf 13 with a width of approximately 0.005 of an inch. The inside diameter of tube 11 is approximately 0.267 of an inch.

An ornament 15 having a bottom 16 is provided with an outside diameter of approximately 0.275 of an inch and a thickness of approximately 0.060 of an inch. The side 17 of the ornament 15 is taped approximately 5° for a distance of approximately 0.030 of an inch. The top 15A of the ornament 15 may be crowned or have a selected configuration as esthetic conditions dictate starting at the end of the tapered side 17 for a distance of approximately 0.030 of an inch.

Figure 2:
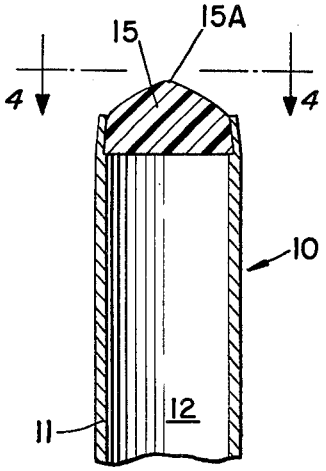
FIG. 2 is fragmentary cross sectional view taken on line 2—2 of FIG. 1, showing an ornament fastened within the upper opening of the top.
Figure 3:
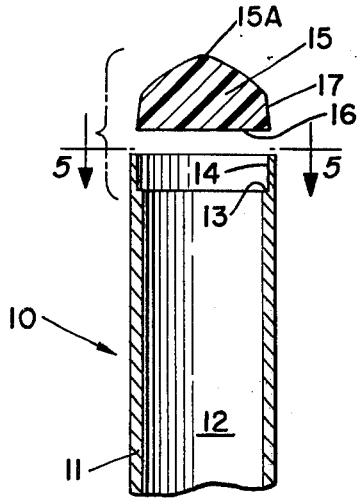
FIG. 3 is a view similar to FIG. 2, showing the construction in the upper end of the top and the configuration of the ornament before insertion into the upper end of the top.
Figure 4:
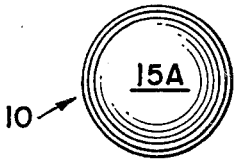
FIG. 4 is a plan view of FIG. 2 as indicated by plane 4—4.
Figure 5:
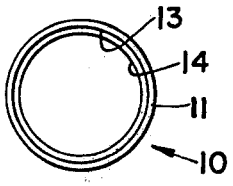
FIG. 5 is a plan view of the upper end of the top, as indicated by plane 5—5 of FIG. 3.

Ornament 15 is set into axial passageway 12 with bottom 16 engaging self 13. Wall 11 for the length of depth 18 is spun over to engage the tapered side 17 and thereby secure ornament 15 in the upper end of axial passageway 12, as seen in FIG. 2.

To add understanding to the present fragile construction; 0.005 of an inch is equivalent to the thickness of a human hair.

The proportional relationship of the fragile parts is restated for clarity and understanding. The thickness of wall 11 is selected as a unit of measure. The counterbore 14 in wall 11 is made to a depth approximately equal to three times the selected unit of measure. The diameter of counterbore 14 creates a shelf 13 with a width approximately equal to one half the selected unit of measure. Ornament 15 has a selected thickness of approximately six times the selected unit of measure. The tapered side 17 extends upward from bottom 16 approximately three times the selected unit of measure with the top 15A having a selected configuration above said tapered side 17.

Ornament 15 may be a precious stone, a birth stone a fraternity, society or religious insignia or a mere closure member of any selected configuration.

Having shown and described a preferred embodiment of the present invention by way of example, it should be realized that structural changes could be made and other examples given without departing from either the spirit or scope of this invention.

What I claim is:

1. A writing instrument top consisting of a hollow tube having a wall and an axial passageway, the thickness of said wall being a selected unit of measure, a counterbore in said wall located in one end of said hollow tube having a depth equal to three times the selected unit of measure, and having a diameter to provide a shelf in said wall with a width, one half the selected unit of measure, an ornament having a bottom and a side provided with an approximate 5° taper from said bottom upward, said ornament being adapted to be inserted into said axial passageway with said bottom engaging said shelf, and spinning said wall against said tapered side to secure said ornament in said counterbore through engagement of said wall with said approximate 5° tapered side.

2. The ornament as defined in claim 1, having a thickness equal to aproximately six times the selected unit of measure and said approximate 5° taper extending approximately three times the selected unit of measure from said bottom upward, said ornament having a top surface subject to selected configuration above said tapered side.

3. The structure as defined in claims 1 and 2 wherein the selected unit of measure is 0.010 of an inch.

4. In the manufacture of a writing instrument top, the method comprising the steps of:

a. selecting a hollow tube having a wall and axial passageway, the thickness of said wall being a selected unit of measure, b. counterboring said wall in one end of said hollow tube to a depth equal to three times the selected unit measure, and to a diameter to provide a shelf in said wall with a width one half the selected unit of measure, c. selecting an ornament having a bottom and a side provided with an approximate 5° taper from said bottom upward, said ornament having a thickness of approximately six times the selected unit of measure, said taper extending upward approximately three times said selectd unit of measure, d. providing said ornament with a selected configuration on top above said tapered side.

e. inserting said ornament into said axial passageway with said bottom engaging said shelf, f. spinning said wall adjacent said counterbore to engage said wall with said approximate 5° taper to fasten said ornament in said axial passageway.

* * * * *